US009576519B2

(12) United States Patent
Guo et al.

(10) Patent No.: US 9,576,519 B2
(45) **Date of Patent: *Feb. 21, 2017**

(54) DISPLAY METHOD AND DISPLAY DEVICE

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventors: Renwei Guo, Beijing (CN); Xue Dong, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 42 days.

This patent is subject to a terminal disclaimer.

(21) Appl. No.: 14/421,978

(22) PCT Filed: Mar. 20, 2014

(86) PCT No.: PCT/CN2014/073794

§ 371 (c)(1),
(2) Date: Feb. 16, 2015

(87) PCT Pub. No.: WO2015/123909

PCT Pub. Date: Aug. 27, 2015

(65) Prior Publication Data

US 2016/0027359 A1 Jan. 28, 2016

(30) Foreign Application Priority Data

Feb. 21, 2014 (CN) ..... 2014 1 0060334

(51) Int. Cl.
*G09G 5/02* (2006.01)
*G09G 3/20* (2006.01)

(52) U.S. Cl.
CPC ..... *G09G 3/2003* (2013.01); *G09G 3/20* (2013.01); *G09G 2300/0452* (2013.01); *G09G 2340/0457* (2013.01); *G09G 2360/16* (2013.01)

(58) Field of Classification Search
CPC G09G 3/2003; G09G 3/20; G09G 2300/0452; G09G 2340/0457

(Continued)

(56) References Cited

U.S. PATENT DOCUMENTS 6,198,467 B1 3/2001 Chiang
7,218,323 B1 * 5/2007 Halmshaw ..... G06T 15/08 345/424

(Continued)

FOREIGN PATENT DOCUMENTS

CN 1549240 A 11/2004
CN 102254504 A 11/2011

OTHER PUBLICATIONS

International Search Report for International Application No. PCT/CN2014/073794.

*Primary Examiner* — Prabodh M Dharia
(74) *Attorney, Agent, or Firm* — Nath, Goldberg & Meyer; Joshua B. Goldberg

(57) ABSTRACT

The invention provides a display method and a display device. The display method in the invention is applicable to a display panel comprising multiple rows of sub-pixels, each row of sub-pixels are formed of sub-pixels of various colors which are alternately and circularly arranged, the sub-pixels in each row are arranged in the same order, and in column direction, sub-pixels of the same color are not adjacent, wherein the display method comprises steps of: S1, generating a primary image based on image information, the primary image is formed of virtual pixels arranged in a matrix, each virtual pixel is formed of sub-pixels of different (Continued)

colors and size of the virtual pixel is the same as that of the sub-pixel of the display panel; S2, calculating a display component of each sub-pixel by using primary components of sampling virtual sub-pixels of the sub-pixel.

18 Claims, 10 Drawing Sheets

(58) Field of Classification Search
USPC ..... 345/55, 83, 88, 419, 589, 690–694; 719/313; 348/51, 54, 302; 313/504
See application file for complete search history.

(56) References Cited

U.S. PATENT DOCUMENTS 9,318,040 B1* 4/2016 Tsai ..... G02F 1/13
9,423,602 B1* 8/2016 Dolgoff ..... G02B 21/22
2002/0113921 A1* 8/2002 Jiang ..... B82Y 15/00 349/96
2003/0095135 A1* 5/2003 Kaasila ..... G06F 3/0481 345/613
2005/0174309 A1* 8/2005 Bouwens ..... G09G 3/22 345/83
2007/0146242 A1 6/2007 Miller et al.
2009/0174638 A1* 7/2009 Brown Elliott ... G02F 1/133621 345/88
2011/0285714 A1* 11/2011 Swic ..... G09G 5/02 345/428
2013/0141470 A1* 6/2013 Wang ..... G09G 3/3648 345/690
2013/0242555 A1* 9/2013 Mukawa ..... G02B 3/0006 362/237
2013/0293753 A1* 11/2013 Keelan ..... H04N 5/3745 348/302
2014/0285542 A1* 9/2014 Izumi ..... G09G 3/2003 345/694
2015/0294628 A1* 10/2015 Nakagawa ..... G09G 3/3607 345/694
2016/0019823 A1* 1/2016 Guo ..... G09G 3/2003 345/55
2016/0027369 A1* 1/2016 Guo ..... G09G 3/2003 345/694
2016/0049110 A1* 2/2016 Shi ..... G09G 3/2003 345/694
2016/0275856 A1* 9/2016 Liu ..... G09G 3/20

* cited by examiner weight coefficients of the sampling virtual sub-pixels of red sub-pixel (1) $\begin{pmatrix} 0.1; & \\ 0.1; & 0.8; \end{pmatrix}$ (2) $\begin{pmatrix} 0.2; & \\ 0.2; & 0.6; \end{pmatrix}$ (3) $\begin{pmatrix} 0.2; & \\ 0.3; & 0.5; \end{pmatrix}$ (4) $\begin{pmatrix} 0.2; & -0.1; \\ 0.3; & 0.6; \end{pmatrix}$ weight coefficients of the sampling virtual sub-pixels of green sub-pixel (5) $\begin{pmatrix} & 0.2; \\ 0.3; & 0.5; \end{pmatrix}$ (6) $\begin{pmatrix} & 0.2; \\ 0.4; & 0.4; \end{pmatrix}$ (7) $\begin{pmatrix} & 0.2; \\ 0.2; & 0.6; \end{pmatrix}$ (8) $\begin{pmatrix} -0.1; & 0.2; \\ 0.2; & 0.7; \end{pmatrix}$ weight coefficients of the sampling virtual sub-pixels of blue sub-pixel (9) $\begin{pmatrix} & 0.8; \\ 0.1; & 0.1; \end{pmatrix}$ (10) $\begin{pmatrix} & 0.6; \\ 0.2; & 0.2; \end{pmatrix}$ (11) $\begin{pmatrix} & 0.5; \\ 0.2; & 0.3; \end{pmatrix}$ (12) $\begin{pmatrix} -0.1; & 0.6; \\ 0.2; & 0.3; \end{pmatrix}$

Fig. 5

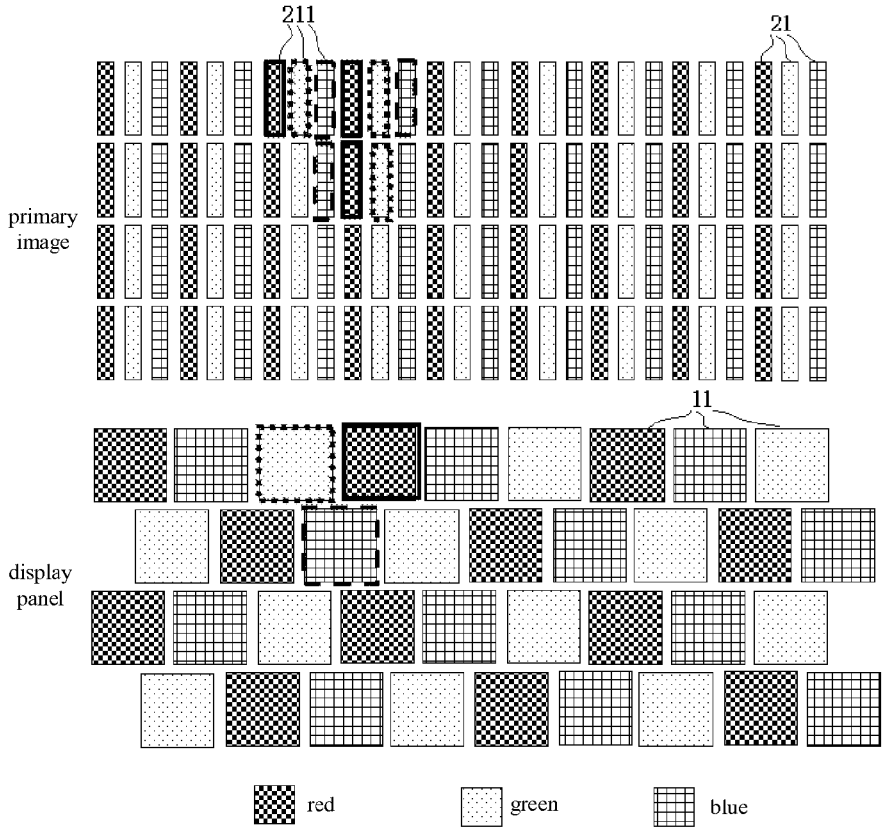

Fig. 6 weight coefficients of the sampling virtual sub-pixels of red sub-pixel (1) $\begin{pmatrix} 0.1; & 0.8; \\ & 0.1; \end{pmatrix}$ (2) $\begin{pmatrix} 0.2; & 0.6; \\ & 0.2; \end{pmatrix}$ (3) $\begin{pmatrix} 0.2; & 0.5; \\ & 0.3; \end{pmatrix}$ (4) $\begin{pmatrix} 0.2; & 0.6; \\ -0.1; & 0.3; \end{pmatrix}$ weight coefficients of the sampling virtual sub-pixels of green sub-pixel (5) $\begin{pmatrix} 0.5; & 0.3; \\ & 0.2; \end{pmatrix}$ (6) $\begin{pmatrix} 0.4; & 0.4; \\ & 0.2; \end{pmatrix}$ (7) $\begin{pmatrix} 0.6; & 0.2; \\ & 0.2; \end{pmatrix}$ (8) $\begin{pmatrix} 0.7; & 0.2; \\ -0.1; & 0.2; \end{pmatrix}$ weight coefficients of the sampling virtual sub-pixels of blue sub-pixel (9) $\begin{pmatrix} 0.1; & 0.1; \\ 0.8; & \end{pmatrix}$ (10) $\begin{pmatrix} 0.2; & 0.2; \\ 0.6; & \end{pmatrix}$ (11) $\begin{pmatrix} 0.2; & 0.3; \\ 0.5; & \end{pmatrix}$ (12) $\begin{pmatrix} 0.2; & 0.3; \\ 0.6; & -0.1; \end{pmatrix}$

Fig. 7

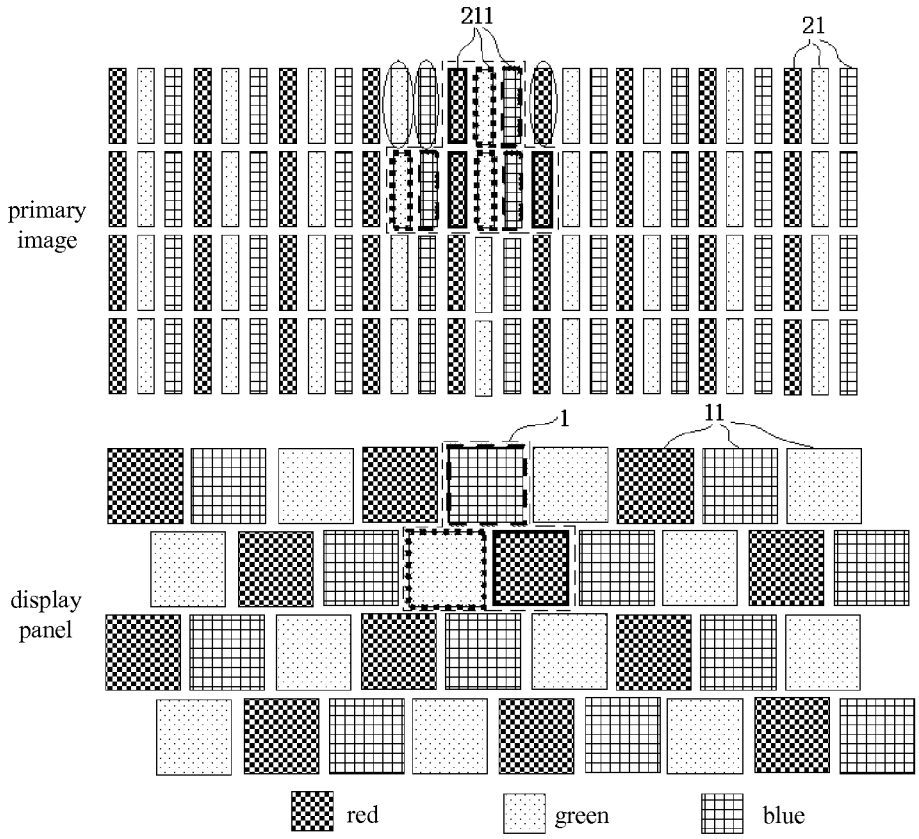

Fig. 8 weight coefficients of the sampling virtual sub-pixels of red sub-pixel (1)
$$\begin{pmatrix} 0; & \\ 0.2; & 0.8; \end{pmatrix}$$

(2)
$$\begin{pmatrix} 0; & \\ 0.3; & 0.7; \end{pmatrix}$$

(3)
$$\begin{pmatrix} 0; & -0.1; \\ 0.3; & 0.8; \end{pmatrix}$$

(4)
$$\begin{pmatrix} -0.1; & -0.1; \\ 0.3; & 0.9; \end{pmatrix}$$

weight coefficients of the sampling virtual sub-pixels of green sub-pixel (5)
$$\begin{pmatrix} 0.3; & \\ 0.5; & 0.2; \end{pmatrix}$$

(6)
$$\begin{pmatrix} 0.2; & \\ 0.6; & 0.2; \end{pmatrix}$$

(7)
$$\begin{pmatrix} 0.1; & \\ 0.8; & 0.1; \end{pmatrix}$$

(8)
$$\begin{pmatrix} 0.2; & -0.1; \\ 0.7; & 0.2; \end{pmatrix}$$

weight coefficients of the sampling virtual sub-pixels of blue sub-pixel (9)
$$\begin{pmatrix} 0.8; & \\ 0.2; & 0; \end{pmatrix}$$

(10)
$$\begin{pmatrix} 0.7; & \\ 0.3; & 0; \end{pmatrix}$$

(11)
$$\begin{pmatrix} 0.8; & -0.1; \\ 0.3; & 0; \end{pmatrix}$$

(12)
$$\begin{pmatrix} 0.9; & -0.1; \\ 0.3; & -0.1; \end{pmatrix}$$

Fig. 10 weight coefficients of the sampling virtual sub-pixels of red sub-pixel (1) $\begin{pmatrix} 0; & 0.2; \\ & 0.8; \end{pmatrix}$ (2) $\begin{pmatrix} 0; & 0.3; \\ & 0.7; \end{pmatrix}$ (3) $\begin{pmatrix} 0; & 0.3; \\ -0.1; & 0.8; \end{pmatrix}$ (4) $\begin{pmatrix} -0.1; & 0.3; \\ -0.1; & 0.9; \end{pmatrix}$ weight coefficients of the sampling virtual sub-pixels of green sub-pixel (5) $\begin{pmatrix} 0.3; & 0.5; \\ & 0.2; \end{pmatrix}$ (6) $\begin{pmatrix} 0.2; & 0.6; \\ & 0.2; \end{pmatrix}$ (7) $\begin{pmatrix} 0.1; & 0.8; \\ & 0.1; \end{pmatrix}$ (8) $\begin{pmatrix} 0.2; & 0.7; \\ -0.1; & 0.2; \end{pmatrix}$ weight coefficients of the sampling virtual sub-pixels of blue sub-pixel (9) $\begin{pmatrix} 0.8; & 0; \\ 0.2; & 0; \end{pmatrix}$ (10) $\begin{pmatrix} 0.7; & 0; \\ 0.3; & 0; \end{pmatrix}$ (11) $\begin{pmatrix} 0.8; & -0.1; \\ 0.3; & 0; \end{pmatrix}$ (12) $\begin{pmatrix} 0.9; & -0.1; \\ 0.3; & -0.1; \end{pmatrix}$

Fig.12 weight coefficients of the sampling virtual sub-pixels of red sub-pixel (1) [0.1; 0.8; 0.1;] (2) [0.15; 0.7; 0.15;] (3) [0.2; 0.6; 0.2;] (4) [0.25; 0.5; 0.25;]

weight coefficients of the sampling virtual sub-pixels of green sub-pixel (5) [0.8; 0.2; 0; ] (6) [0.7; 0.3; 0; ] (7) [0.6; 0.4; 0; ] (8) [0.6; 0.4; -0.1; ]

weight coefficients of the sampling virtual sub-pixels of blue sub-pixel (9) [ 0; 0.2; 0.8; ] (10) [ 0; 0.3; 0.7; ] (11) [ 0; 0.4; 0.6;] (12) [-0.1 0.4; 0.6; ]

DISPLAY METHOD AND DISPLAY DEVICE

This is a National Phase Application filed under 35 U.S.C. 371 as a national stage of PCT/CN2014/073794, filed Mar. 20, 2014, an application claiming the benefit of Chinese Application No. 201410060334.8, filed Feb. 21, 2014, the content of each of which is hereby incorporated by reference in its entirety.

FIELD OF THE INVENTION

The invention relates to the field of display technology, and particularly to a display method and a display device.

BACKGROUND OF THE INVENTION

As shown in FIG. 1, a conventional display panel consists of a plurality of square pixels 1, and each pixel 1 consists of three continuously arranged sub-pixels of different colors in the same row, for example, a red sub-pixel 11, a green sub-pixel 11 and a blue sub-pixel 11, wherein each sub-pixel 11 typically is rectangular strip-shaped, so that a square pixel 1 can be formed by arranging three sub-pixels 11 one by one. During displaying, display content of the three sub-pixels 11 in a pixel 1 are mixed so as to form a "display point" which is visible outside.

With the development of technology, resolution of the display panel is higher and higher, that is, the number of pixels per unit area is more and more, which requires the size of each sub-pixel to be smaller and smaller. However, because of constraints in process, obviously the size of the sub-pixel cannot be unlimitedly reduced.

To improve the display effect in a case that the size of the sub-pixel is fixed, a display panel of Pentile mode has been proposed. In the display panel of Pentile mode, the number of sub-pixels of certain colors (such as red sub-pixels and blue pixels) is halved, at the same time, sub-pixels of different colors are regarded to be in different "layers", and every layer is divided into multiple sampling regions, wherein sampling regions in different layers are not overlapped, then content to be displayed by each sub-pixel is calculated by using area ratios of sampling regions. In the display panel of Pentile mode, some sub-pixels are "shared", so that a resolution higher than the actual resolution is realized in visual effect.

However, the display effect of the display panel of Pentile mode is still unsatisfactory. Since the number of sub-pixels of certain colors is havled, the sub-pixels of various colors are distributed non-uniformly, which easily results in jagged lines, grid spots, the problem that fine content cannot be clearly displayed and the like. Meanwhile, since a calculation mode of "layer-dividing and region-dividing" is adopted, determination of the content to be displayed by each sub-pixel requires complex calculation, thus amount of calculation is huge.

SUMMARY OF THE INVENTION

In view of the above problems of poor display effect and large amount of calculation in the existing high resolution display technology, the present invention provides a display method and a display device with high resolution, excellent display effect and small amount of calculation.

A solution to solve the above problems in the present invention is a display method, which is applicable to a display panel comprising multiple rows of sub-pixels, each row of sub-pixels are formed of sub-pixels of various colors which are alternately and circularly arranged, the sub-pixels in each row are arranged in the same order, and in column direction, sub-pixels of the same color are not adjacent, wherein the display method comprises steps of:

S1, generating a primary image based on image information, wherein the primary image is formed of virtual pixels arranged in a matrix, each of the virtual pixels is formed of sub-pixels of different colors and size of the virtual pixel is the same as that of the sub-pixel of the display panel;

S2, calculating a display component of each sub-pixel by using primary components of sampling virtual sub-pixels of the sub-pixel, wherein sampling virtual sub-pixels of one sub-pixel include multiple virtual sub-pixels, which are adjacent to a corresponding position of the one sub-pixel in the primary image and have the same color as the one sub-pixel.

Preferably, both of the sub-pixel and the virtual pixel are square.

Preferably, the display panel consists of a plurality of pixels, and each of the pixels comprises multiple sub-pixels, which are adjacent and have different colors, and wherein the sampling virtual sub-pixels of one sub-pixel comprise a virtual pixel, which has the same color as the one sub-pixel and corresponds to a corresponding position of a pixel including the one sub-pixel in the primary image.

Further preferably, the sampling virtual sub-pixels of one sub-pixel further comprise at least one virtual sub-pixel, which has the same color as the one sub-pixel and is adjacent to a corresponding position of a pixel including the one sub-pixel in the primary image.

Further preferably, each row of sub-pixels in the display panel are formed of sub-pixels of three colors which are alternately and circularly arranged; and each virtual pixel of the primary image consists of three virtual sub-pixels of different colors.

Further preferably, any two adjacent sub-pixels in column direction are staggered by ½ sub-pixels in row direction;

each pixel includes two adjacent sub-pixels in the same row, and a sub-pixel which is in an adjacent row and is in the middle of the two adjacent sub-pixels in row direction.

Further preferably, any two adjacent sub-pixels in column direction are aligned in row direction, and each pixel includes two adjacent sub-pixels in the same column, and a sub-pixel which is in an adjacent column and is in the same row as one of the two adjacent sub-pixels.

Further preferably, any two sub-pixels adjacent in column direction are aligned in row direction, and each pixel includes three continuous sub-pixels in the same row.

Further preferably, the step S2 comprises: multiplying primary components of respective sampling virtual sub-pixels of one pixel by weight coefficients of the respective sampling virtual sub-pixels, and adding them up to obtain a display component of the sub-pixel.

Further preferably, a sum of the weight coefficients of the sampling virtual sub-pixels of one sub-pixel is 1.

Further preferably, the sampling virtual sub-pixels of one sub-pixel include a main sampling virtual sub-pixel, which has the same color as the sub-pixel and corresponds to a corresponding position of the sub-pixel in the primary image; and among the sampling virtual sub-pixels of one sub-pixel, the main sampling virtual sub-pixel has the largest weight coefficient.

Further preferably, the main sampling virtual sub-pixel has a weight coefficient ranging from 0.5 to 0.9.

Further preferably, the sampling virtual sub-pixels of one sub-pixel, except the main sampling virtual sub-pixel, have weight coefficients ranging from −0.1 to 0.3.

A solution to solve the above problems in the present invention is a display device comprising a display panel which comprises pixels arranged in a matrix, which comprise multiple rows of sub-pixels, each row of sub-pixels are formed of sub-pixels of various colors which are alternately and circularly arranged, the sub-pixels in each row are arranged in the same order, and in column direction, sub-pixels of the same color are not adjacent, wherein the display device further comprising:

a primary image generating module for generating a primary image based on image information, the primary image is formed of virtual pixels arranged in a matrix, each of the virtual pixels is formed of sub-pixels of different colors and size of the virtual sub-pixel is the same as that of the sub-pixel of the display panel;

a display component calculating module for calculating a display component of each sub-pixel by using primary components of sampling virtual sub-pixels of the sub-pixel, wherein sampling virtual sub-pixels of one sub-pixel include multiple virtual sub-pixels, which are adjacent to a corresponding position of the one sub-pixel in the primary image and have the same color as the one sub-pixel; and a display driving module for driving the sub-pixels of the display panel to display according to their respective display components.

In the display method and the display device in the present invention, a display content is processed to be a primary image, each of virtual pixels in the primary image corresponds to an actual sub-pixel, and the display content of each sub-pixel is decided by multiple virtual sub-pixels in the primary image. Therefore, each sub-pixel may simultaneously represent the display contents of a plurality of virtual sub-pixels in the primary image, "sharing" of the sub-pixels is realized, a higher resolution may be obtained in visual effect, and display effect is improved and amount of calculation is small.

BRIEF DESCRIPTION OF THE DRAWINGS

FIG. 5 is a diagram illustrating the distribution of weight coefficients of sampling virtual pixels in FIG. 4 of the invention.

FIG. 6 is a diagram illustrating another extracting method for sampling virtual pixels of one pixel in the display panel in the embodiment 1 of the invention;

FIG. 7 is a diagram illustrating the distribution of weight coefficients of sampling virtual pixels in FIG. 6 of the invention.

FIG. 8 is a diagram illustrating another extracting method for sampling virtual pixels of one pixel in the display panel in the embodiment 1 of the invention;

FIG. 10 is a diagram illustrating the distribution of weight coefficients of sampling virtual pixels in FIG. 9 of the invention.

FIG. 12 is a diagram illustrating the distribution of weight coefficients of sampling virtual pixels in FIG. 11 of the invention.

REFERENCE SIGNS

1-pixel; 11-sub-pixel; 2-virtual pixel; 21-virtual sub-pixel; 211-sampling virtual sub-pixel.

DETAILED DESCRIPTION OF THE EMBODIMENTS

In order to make persons skilled in the art better understand solutions of the present invention, the present invention will be described in detail below in conjunction with the drawings and embodiments.

Embodiment 1

As shown in FIG. 2 to FIG. 14, the present embodiment provides a display method, which is applicable to the following display panel, the display panel comprises multiple rows of sub-pixels 11, each row of sub-pixels 11 are formed of sub-pixels 11 of various colors which are alternately and circularly arranged, and the sub-pixels 11 in each row are arranged in the same order.

Preferably, the sub-pixels 11 have three colors, for example, each sub-pixel 11 may be a red sub-pixel 11, a green sub-pixel 11 or a blue sub-pixel 11 (i.e., in a RGB mode), and in the present embodiment, introduction will be made by taking the sub-pixels 11 of three colors as an example.

Figure 1:
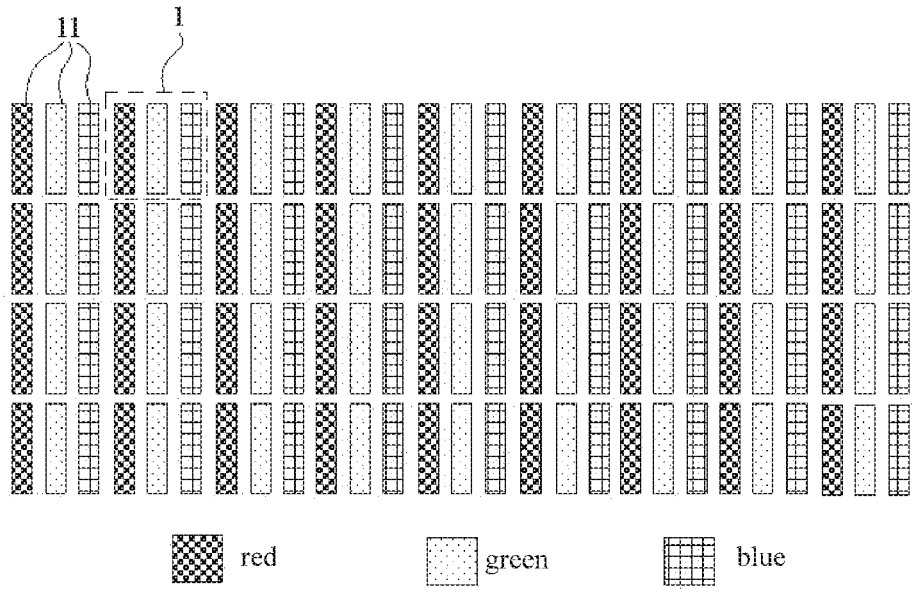
Fig. 1 (Prior Art)
FIG. 1 is a diagram illustrating the distribution of pixels in an existing display panel.
Figure 2:
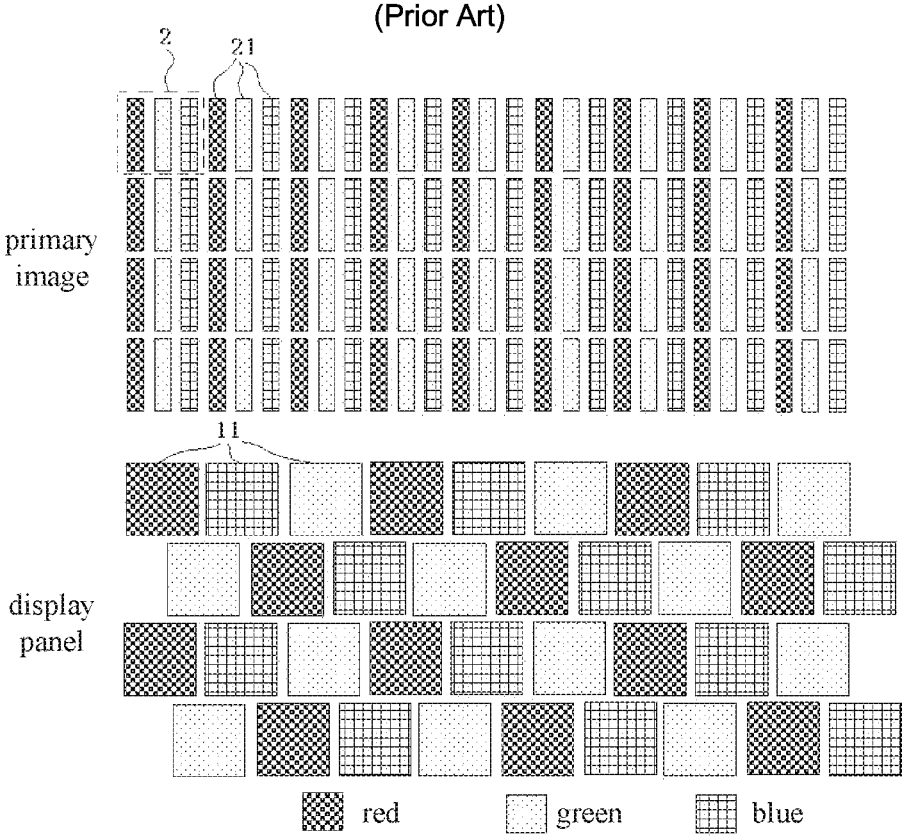
FIG. 2 is a diagram illustrating a correspondence relationship between a display panel in an embodiment 1 of the invention and a primary image.

That is to say, as shown in FIG. 2, in each row, three sub-pixels 11 of different colors form a cycle unit (for example, the cycle unit consisting of a red sub-pixel 11—a green sub-pixel 11—a blue sub-pixel 11), multiple such cycle units are repeatedly arranged so as to form a row of sub-pixels 11. Among the multiple rows of sub-pixels, starting sub-pixels may have different colors, but the sub-pixels are arranged and repeated in the same manner. For example, in FIG. 2, in the first row, the first sub-pixel is a red sub-pixel 11, and the sub-pixels in the row are arranged sequentially and periodically in an order of "a red sub-pixel 11—a blue sub-pixel 11—a green sub-pixel 11—a red sub-pixel 11", in the second row, the first sub-pixel is a green sub-pixel 11, and the sub-pixels in the row are arranged sequentially and periodically in an order of "a green sub-pixel 11—a red sub-pixel 11—a blue sub-pixel 11—a green sub-pixel 11", and it can be seen from above, the sub-pixels 11 in these two rows are actually arranged in the same order.

The sub-pixel 11 in the display panel is preferably of a square.

That is to say, the sub-pixels 11 are the same in sizes in row direction and column direction, so that the shape of each sub-pixel 11 is actually equivalent to that of one pixel (i.e., three sub-pixels) in the existing display panel.

Meanwhile, in column direction, sub-pixels 11 of the same color are not adjacent.

That is to say, in column direction, unlike the existing display panel in which sub-pixels of the same color are arranged in one column, sub-pixels 11 of the same color are not adjacent in the present embodiment.

Preferably, as shown in FIG. 2 to FIG. 4, FIG. 6 and FIG. 8, as an example of the present embodiment, any two adjacent sub-pixels 11 in column direction are staggered by ½ sub-pixels in row direction.

That is to say, as a preferable example of the display panel of the present embodiment, various rows may be unaligned, namely, starting positions of any two adjacent rows are staggered by ½ sub-pixels 11, so that in column direction, every sub-pixel 11 (except the few sub-pixels in edge regions) is adjacent to two sub-pixels 11 in its adjacent row, and is positioned at the middle of the two sub-pixels 11, it can be seen that, three sub-pixels 11 of different colors interlaces to exhibit a "品" shape, and such an arrangement may result in a more uniform distribution of the sub-pixels 11 of three colors, which can further improve the display quality.

Figure 9:
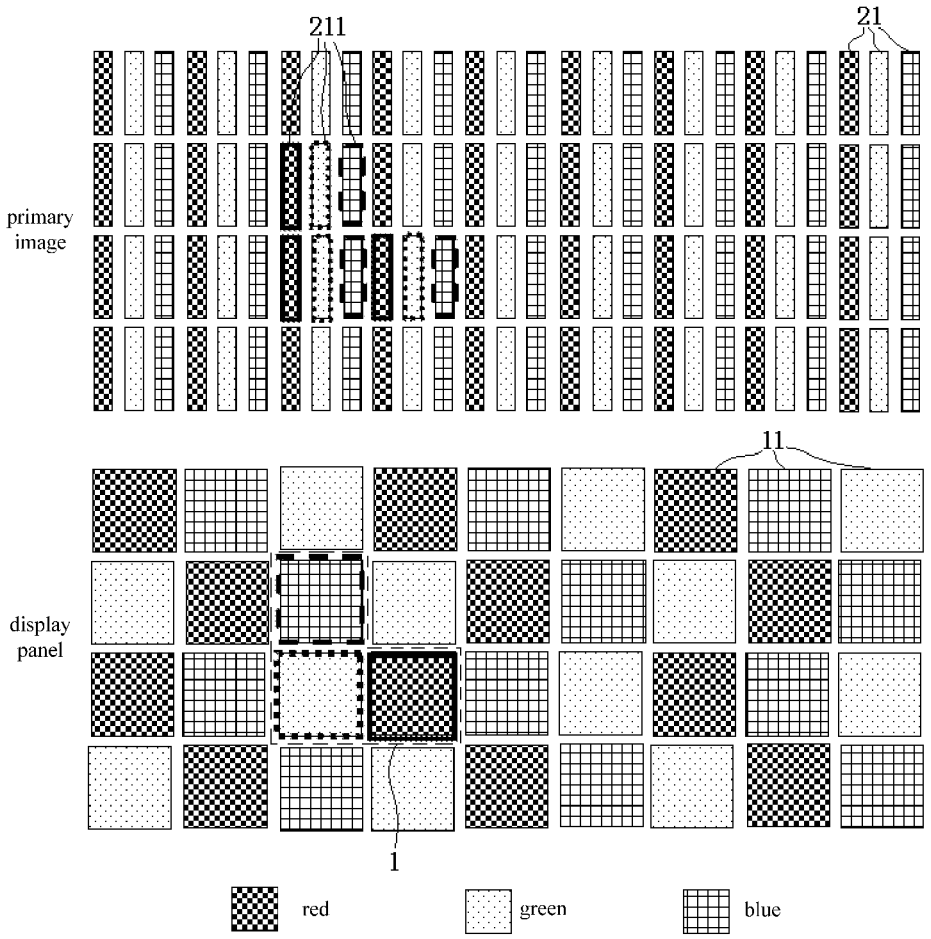
FIG. 9 is a diagram illustrating another extracting method for sampling virtual pixels of one pixel in the display panel in the embodiment 1 of the invention.
Figure 11:
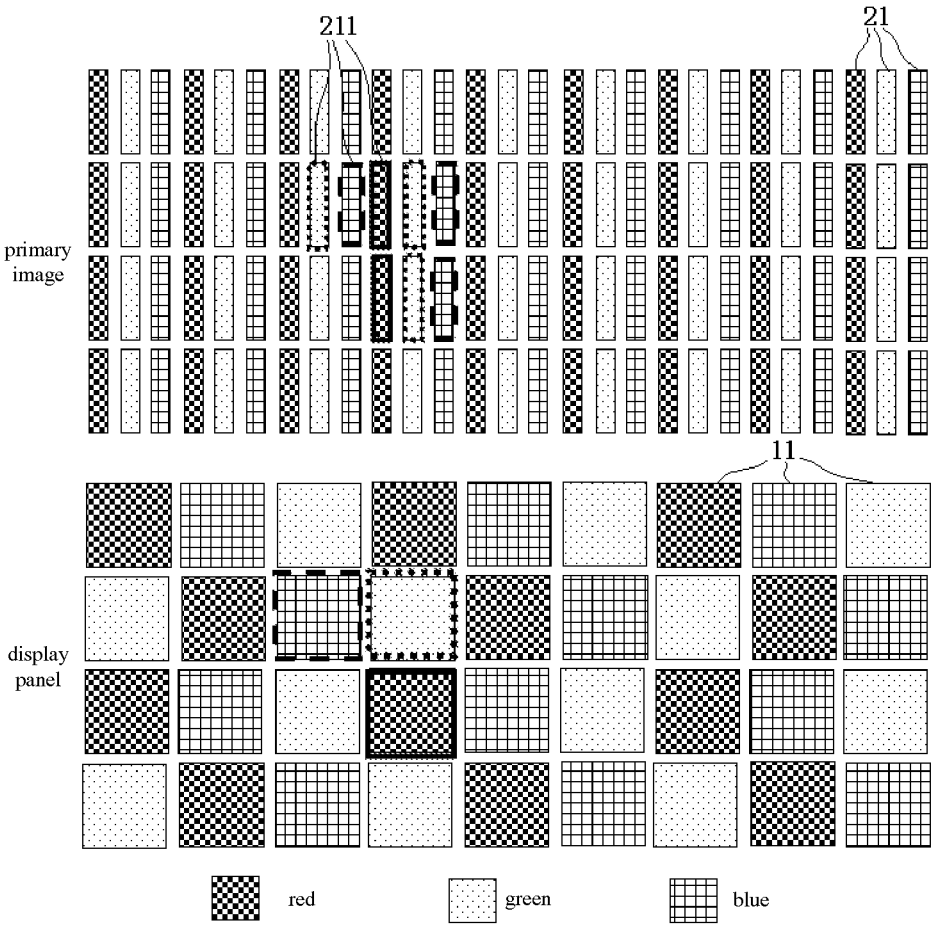
FIG. 11 is a diagram illustrating another extracting method for sampling virtual pixels of one pixel in the display panel in the embodiment 1 of the invention.
Figures 13, 14:
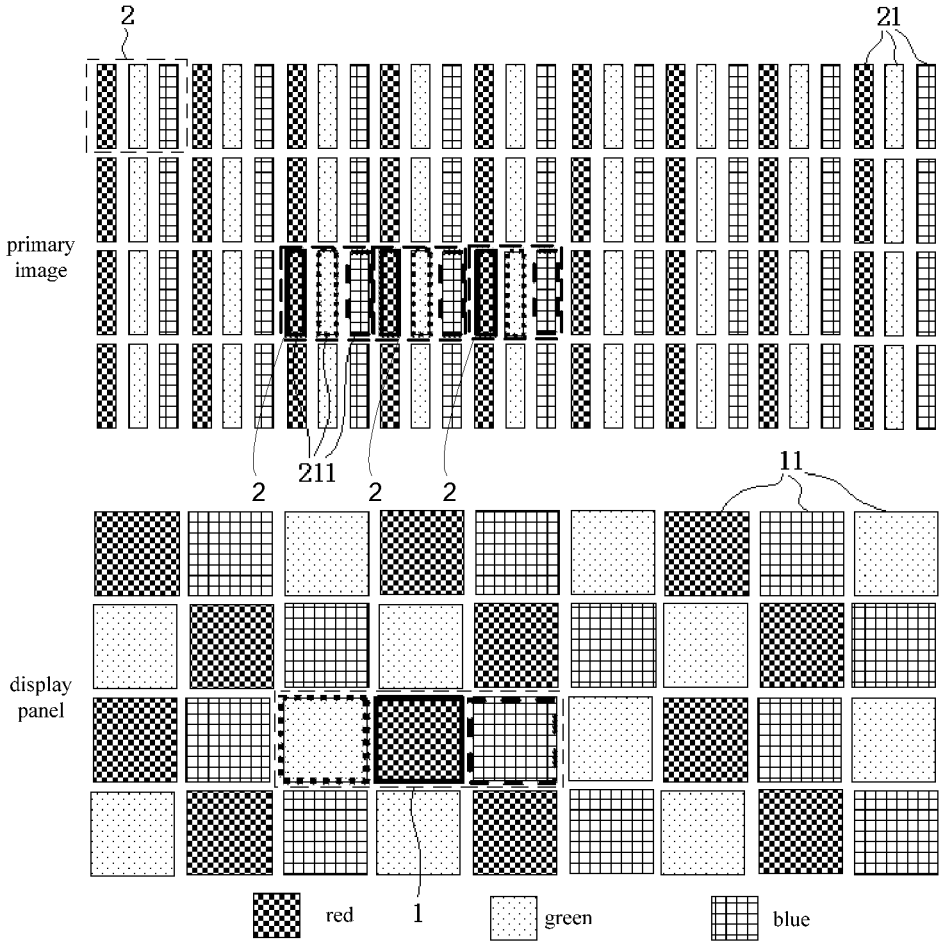
FIG. 13 is a diagram illustrating another extracting method for sampling virtual pixels of one pixel in the display panel in the embodiment 1 of the invention.
FIG. 14 is a diagram illustrating the distribution of weight coefficients of sampling virtual pixels in FIG. 13 of the invention.

Preferably, as shown in FIG. 9, FIG. 11 and FIG. 13, as another example of the present embodiment, any two sub-pixels 11 adjacent in column direction are aligned in row direction.

That is to say, as another preferable example of the present embodiment, the sub-pixels 11 may be aligned so as to be arranged in a conventional matrix form.

Specifically, the display panel of the present embodiment may be an organic light-emitting diode (OLED) panel, namely, each of the sub-pixels 11 thereof includes a light-emitting unit (organic light-emitting diode), and the light-emitting unit of each sub-pixel 11 directly emits light of desired color. Alternatively, the display panel may be a liquid crystal display, namely, each of the sub-pixels 11 thereof includes a color filter unit, and color of light transmitted through the color filter unit of the sub-pixel 11 becomes desired color.

In summary, the display panel may be of any of various types, so long as the distribution of the sub-pixels 11 is consistent with the above conditions, which will not be described in detail herein.

The display method of the present embodiment comprises following steps:

S101, generating a primary image based on image information, wherein the primary image is formed of virtual pixels 2 arranged in a matrix, each virtual pixel 2 consists of three virtual sub-pixels 21 of different colors (of course, if the number of colors of the sub-pixels 11 in the display panel is increased, then the number of the virtual sub-pixels 21 of each virtual pixel 2 is also increased accordingly), and is the same as the sub-pixel 11 in the display panel in size.

That is to say, as shown in FIG. 2, image information (that is, content of an image to be displayed), for example from the display card, is processed to generate a primary image, the primary image is formed of a plurality of "virtual pixels 2" arranged in a matrix, and each of the virtual pixels 2 is equivalent to a "point" (which preferably is a square point) in the primary image, and consists of three virtual sub-pixels 21 of different colors (in other words, the primary image is an image to be displayed in the existing display panel). Meanwhile, the size of each virtual pixel 2 is the same as that of a sub-pixel 11 in the display panel of the present embodiment, thus each sub-pixel 11 in the display panel corresponds to three virtual sub-pixels 21 in the primary image.

S102, calculating a display component of one sub-pixel 11 by using primary components of sampling virtual sub-pixels 211 of the sub-pixel 11, wherein sampling virtual sub-pixels 211 of one sub-pixel 11 include multiple virtual sub-pixels 21, which are adjacent to a corresponding position of the one sub-pixel 11 in the primary image (which is called as a corresponding position for short blow) and have the same color as the one sub-pixel 11.

The "component" in the "primary component", "display component" or the like refers to a quantity of color to be displayed by a corresponding virtual sub-pixel 21 or sub-pixel 11, and can be represented as "brightness". Of course, so long as the "component" may represent the "quantity" to be displayed, it may use any other measurement parameter, such as "gray level (grayscale)", "saturation" and the like, as unit of the "component".

As above, each sub-pixel 11 in the display panel of the present embodiment corresponds to multiple virtual sub-pixels 21 of different colors, however, obviously, the sub-pixel 11 cannot simultaneously display the contents of these virtual sub-pixels 21, therefore, it is required to further determine the content to be displayed by the sub-pixel 11, and the calculation method is as follows: taking a plurality of virtual sub-pixels 21 of the same color as the sub-pixel 11 adjacent to a corresponding position of the sub-pixel 11 in the primary image (for example, for a red sub-pixel 11, the virtual sub-pixels 21 of the same color as it are the virtual sub-pixels 21 of red color) as its sampling virtual sub-pixels 211, and using these sampling virtual sub-pixels 211 to calculate the display content of the sub-pixel 11.

According to the display method of the present embodiment, the display content is processed to be a primary image, each virtual pixel 2 (three virtual sub-pixels 21) in the primary image corresponds to an actual sub-pixel 11, and the display content of each sub-pixel 11 is decided by multiple virtual sub-pixels 21 in the primary image. Therefore, each sub-pixel 11 may simultaneously represent the display contents of a plurality of virtual sub-pixels 21 in the primary image, "sharing" of the sub-pixel 11 is realized, a higher resolution may be obtained in visual effect, display effect is improved and amount of calculation is small.

Preferably, the above calculating a display component of one sub-pixel 11 by using primary components of sampling virtual sub-pixels 211 of the sub-pixel 11 may comprise:

multiplying the primary components of sampling virtual sub-pixels 211 of the one sub-pixel 11 by respective weight coefficients of the sampling virtual sub-pixels and adding them up to obtain the display component of the sub-pixel 11.

That is to say, the display content of each sub-pixel 11 may be decided by both the display contents of multiple virtual sub-pixels 21 of the same color as the sub-pixel 11 around the corresponding position of the sub-pixel 11 in the primary image (sampling virtual sub-pixels 211) and weight assigning proportions thereof, in other words, specific components may be "extracted" from all of the sampling virtual sub-pixels 211 of one sub-pixel 11 according to their proportions and added up so as to obtain a component to be displayed by the sub-pixel 11.

Preferably, the sum of the weight coefficients of all sampling virtual sub-pixels 211 of one sub-pixel 11 is 1.

Apparently, when the sum of the weight coefficients of the sampling virtual sub-pixels 211 is 1, compared to the overall brightness of the primary image, the overall brightness of the display panel will not be increased or reduced, thus ensuring that the display picture may not be changed.

Preferably, the sampling virtual sub-pixels 211 of one sub-pixel 11 include a main sampling virtual sub-pixel 211, which is a virtual sub-pixel 21 and has the same color as the sub-pixel 11, and corresponds to a corresponding position of the sub-pixel 11 in the primary image; among the sampling virtual sub-pixels 211 of one sub-pixel 11, the main sampling virtual sub-pixel 211 has the largest weight coefficient.

Further preferably, the main sampling virtual sub-pixel 211 has a weight coefficient ranging from 0.5 to 0.9.

Further preferably, the sampling virtual sub-pixels 211 of one sub-pixel 11, except the main sampling virtual sub-pixel 211, have weight coefficients ranging from −0.1 to 0.3.

Apparently, for a sub-pixel 11, the further the distance from a sampling virtual sub-pixel 211 to the corresponding position of the sub-pixel 11 is, the less the sampling virtual sub-pixel 211 has influence on the content of the sub-pixel 11; and the main sampling virtual sub-pixel 211 is a sampling virtual sub-pixel 211, which is directly overlapped with the corresponding position of the sub-pixel 11, therefore, the distance between the main sampling virtual sub-pixel 11 and the corresponding position is smallest, thus the main sampling virtual sub-pixel 211 has largest influence on the sub-pixel 11, and the proportion of the weight of the main sampling virtual sub-pixel 211 should be the largest. When the weight coefficients of the main sampling virtual sub-pixel 211 and other sampling virtual sub-pixels 211 are in the above ranges respectively, an optimal display effect can be obtained.

The weight coefficient of any other sampling virtual sub-pixel 211 may be a negative value or zero; when the weight coefficient of one sampling virtual sub-pixel 211 is a negative value, it may actually reduce the display component of the sub-pixel 11 so as to correct the display component of the sub-pixel 11; and when the weight coefficient of one sampling virtual sub-pixel 211 is zero, it can be regarded to have no influence on the display component of the sub-pixel 11.

Hereinafter, a calculation procedure of the display component of the sub-pixel 11 will be introduced in conjunction with the selection of the sampling virtual sub-pixels 211.

Figure 3:
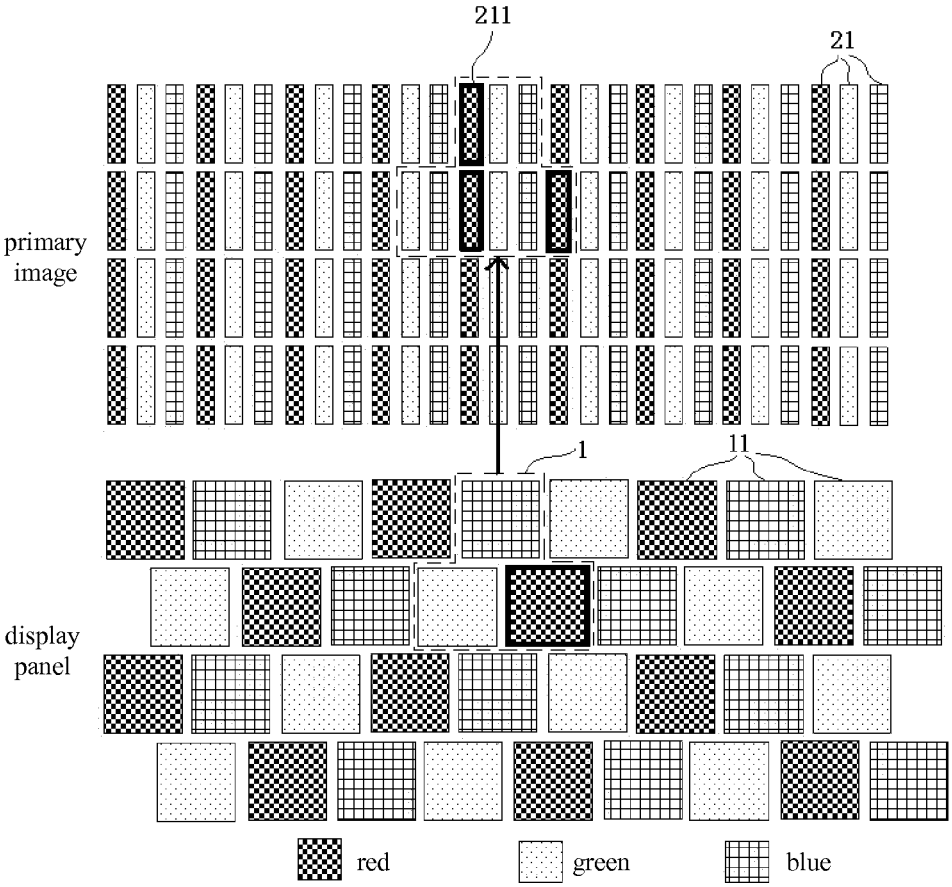
FIG. 3 is a diagram illustrating that one pixel in the display panel in the embodiment 1 of the invention corresponds to a region in the primary image.
Figure 4:
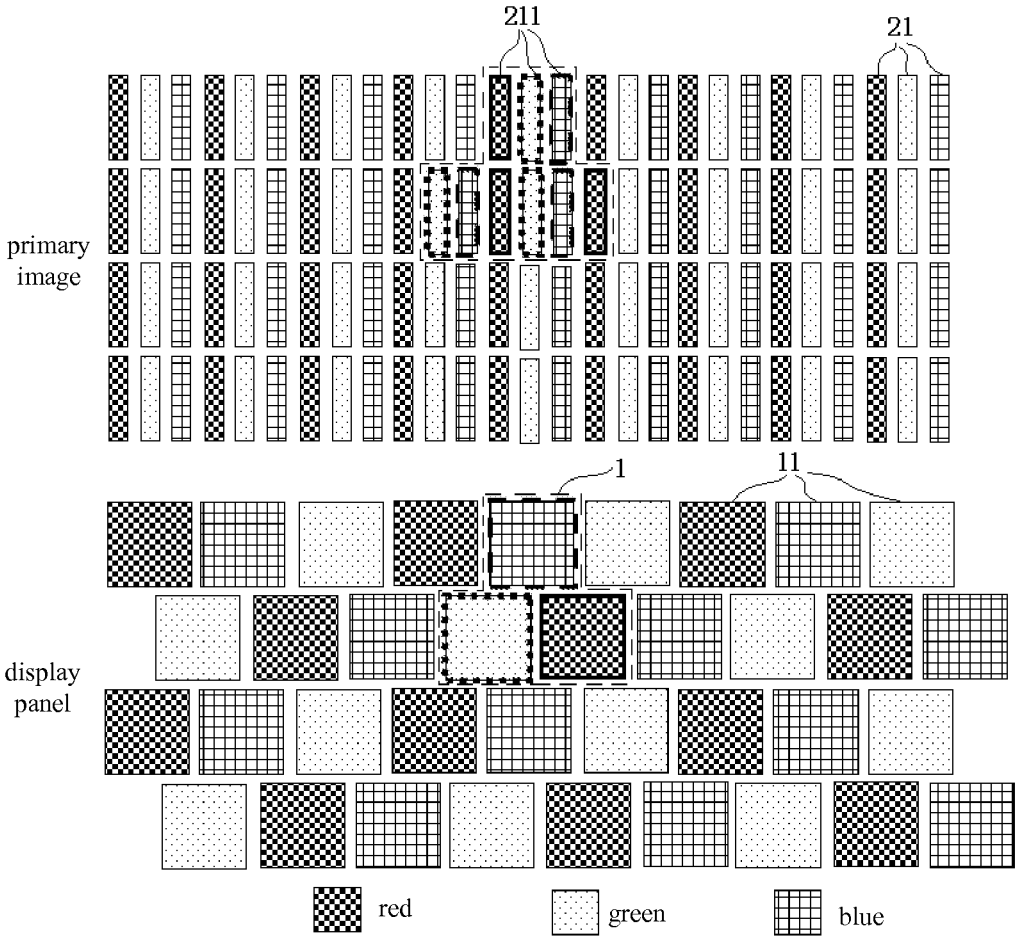
FIG. 4 is a diagram illustrating an extracting method for sampling virtual pixels of one pixel in the display panel in the embodiment 1 of the invention.

Preferably, as shown in FIG. 3, FIG. 4 and FIG. 9, the display panel consists of multiple pixels 1, each of the pixels 1 comprises three sub-pixels 11 which are adjacent and have different colors; and the sampling virtual sub-pixels 211 of one sub-pixel 11 includes: multiple virtual sub-pixels 21, which are adjacent to a corresponding position of the pixel 1 including the one sub-pixel 11 in the primary image and have the same color as the one sub-pixel 11.

That is to say, the multiple sub-pixels 11 in the display panel of the present embodiment may be divided into a plurality of pixels 1, and each of the pixels 1 includes a red sub-pixel 11, a blue sub-pixel 11 and a green sub-pixel 11. Thus, each pixel 1 includes three sub-pixels 11, and a corresponding position of the pixel 1 in the primary image (in other words, corresponding positions of the three sub-pixel 11) of course corresponds to some virtual sub-pixels 21 (the virtual sub-pixels 21 within the dotted line frame in figures), these virtual sub-pixels 21 are the sampling virtual sub-pixels 211 of the three sub-pixels 11 of the pixel 1, respectively.

Apparently, for different display panels, since the sub-pixels 11 are arranged in different manners, selections of the pixel 1 and the sampling virtual sub-pixels 211 are different.

Preferably, as shown in FIG. 3 and FIG. 4, in the above display panel in which the sub-pixels in two adjacent rows are staggered by 1/2 sub-pixels, each pixel 1 includes two adjacent sub-pixels 11 in the same row, and a sub-pixel 11 in an adjacent row, a position of which in row direction is in the middle of the two adjacent sub-pixels 11.

That is to say, when the sub-pixels in two adjacent rows are staggered by 1/2 sub-pixels, each pixel 1 may consist of three sub-pixels 11, which are distributed in a "品" shape, and the pixels 1 adjacent in row direction may have different orientations of the "品" shape (of course, according to the above arrangement manner, a lonely sub-pixel 11 may occur at some edge position of the display panel, however, which has no influence on realization of the invention)

At this time, as shown in FIG. 3, a red sub-pixel 11 with a thick solid frame is in the pixel 1, there are three red virtual sub-pixels 21 in a corresponding region of the pixel 1, that is, the three red virtual sub-pixels 21 with thick solid frames, thus these three red virtual sub-pixels 21 are the sampling virtual sub-pixels 211 corresponding to the red sub-pixel 11. As such, as shown in FIG. 4, the sampling virtual sub-pixels 211 (with thick dotted frames) of the green sub-pixel 11 (with a thick dotted frame) and the sampling virtual sub-pixels 211 (with thick dashed frames) of the blue sub-pixel 11 (with a thick dashed frame) in the pixel 1 may be selected in a similar manner.

Of course, it should be understood that, for the sub-pixels 11 in even rows in figures, starting position of each sub-pixel 11 thereof corresponds to a middle position of a virtual sub-pixel 21, therefore, this sub-pixel 11 of course corresponds to two "half virtual sub-pixels 21" of the same color, and at this time, one or both of these two "half virtual sub-pixels 21" may be selected to be in a corresponding range of the pixel 1 as desired.

At this time, weight coefficients corresponding to the sampling virtual sub-pixels 211 may be those shown in FIG. 5, the numerals represent the weight coefficients corresponding to the sampling virtual sub-pixels 211, which are at corresponding positions and have desired colors, wherein the largest coefficient in each coefficient set is the weight coefficient of the main sampling virtual sub-pixel 211, i.e., the weight coefficient of the sampling virtual sub-pixel 211 overlapping with the corresponding position of the sub-pixel 11, and a blank position represents that the virtual sub-pixel 21 at this position is not used as the sampling virtual sub-pixel 211. In figures, the weight coefficients of the sampling virtual sub-pixels 211 of various colors may be assigned in various manners (for example, the weight coefficients of the red sampling virtual sub-pixels 211 may be selected as a matrix consisting of numbers 1-4), which may be decided as desired.

Of course, in the above, only an example for selections of the weight coefficients and the sampling virtual sub-pixels 211 is described, and the weight coefficients and the sampling virtual sub-pixels 211 may also be selected in other manners such as those shown in FIG. 6 and FIG. 7.

Preferably, sampling virtual sub-pixels 211 of a sub-pixel 11 further include: at least one virtual sub-pixel 21, which has the same color as the sub-pixel 11 and is adjacent to a corresponding position of a pixel 1 including the sub-pixel 11 in the primary image.

That is to say, as shown in FIG. 8, for a sub-pixel 11, the sampling virtual sub-pixels 211 thereof may further include, in addition to the three virtual sub-pixels 21 corresponding to the pixel 1 including the sub-pixel 11, other virtual sub-pixels 21 (such as virtual sub-pixels 21 with circles in FIG. 8), which are outside but adjacent to the corresponding position of the pixel 1 and have the same color. For example, the sampling virtual sub-pixels 211 of the red sub-pixel 11 with a thick continuous frame in FIG. 8 may further include the red virtual sub-pixel 21 with a circle. When there is a sampling virtual sub-pixel 211 outside a region corresponding to the pixel 1, the weight coefficients of the sampling virtual sub-pixels 211 may be selected according to matrixes (4), (8) and (12) shown in FIG. 5, that is, positions not being used as the sampling virtual sub-pixels 211 as mentioned above are used as the sampling virtual sub-pixels 211 now, and are assigned with weight coefficients.

Preferably, as shown in FIG. 9 and FIG. 11, for the display panel in which the above sub-pixels 11 are aligned, each pixel 1 comprises two adjacent sub-pixels 11 in the same column, and a sub-pixel 11, which is in an adjacent column and in the same row as one of the two adjacent sub-pixels 11.

That is to say, when the sub-pixels 11 in adjacent rows are aligned, each pixel 1 may include three sub-pixels 11, which are arranged to be of "L"-shape, and the "L"-shapes of adjacent pixels 1 in row direction may be different in orientation.

Accordingly, the virtual pixels 2 corresponding to each pixel 1 are also shown in FIG. 9 and FIG. 10, and the weight coefficients of the sampling virtual sub-pixels 211 may be those shown in FIG. 10 and FIG. 12, which will not be repeated herein.

Preferably, as another example of the present embodiment, as shown in FIG. 13, for the display panel in which the sub-pixels 11 are aligned, each pixel 1 may include three continuous sub-pixels 11 in the same row.

That is to say, when the pixels 11 in adjacent rows are aligned, each pixel 1 may include three continuous sub-pixels 11 of different colors in the same row, namely, the pixel 1 may be selected in the same manner as the prior art. Accordingly, the sampling virtual sub-pixels 211 corresponding to respective sub-pixels 11 in each pixel 1 are shown in FIG. 13, wherein three sampling virtual sub-pixels 211 of a sub-pixel 11 are arranged in the same row, and are respectively in three adjacent virtual pixels 2, meanwhile, for the three sub-pixels in a pixel 1, their sampling virtual sub-pixels 211 are also arranged in the same row, and just form three adjacent virtual pixels 2. The weight coefficients of the sampling virtual sub-pixels 211 may be those shown in FIG. 14, wherein the weight coefficient of the sampling virtual sub-pixel 211 directly corresponding to the corresponding position of the sub-pixel 11 is largest, and the weight coefficients of the other two sampling virtual sub-pixels 211 are relatively small.

When adopting the above manner for dividing the pixel 1, and the above manner for selecting the sampling virtual sub-pixels 211 and ranges of weight coefficients thereof, a better display effect can be realized. It should be understood that, the above manner for dividing the pixel 1, the above manner for selecting the sampling virtual sub-pixels 211 and ranges of weight coefficients thereof, and the like are not used to limit the present invention, many modifications may be made to the display method of the present invention, for example, the shape of the pixel 1 may be changed, moreover, part of the virtual sub-pixels 21 in the region corresponding to the pixel 1 may not be used as the sampling virtual sub-pixels 211 (for example, in the figures showing the weight coefficients, weight coefficients of part of the sampling virtual sub-pixels 211 are zero, which means that they are not used as the sampling virtual sub-pixels 211 at this time).

In the above embodiment, the invention has been described by taking each pixel (or virtual pixel) in the display panel (or the primary image) includes three sub-pixels (or virtual sub-pixels) of different colors as an example. However, it should be understood that, each pixel may also include more than three sub-pixels of different colors, for example, each pixel may also include a white sub-pixel (RGBW mode), or a yellow sub-pixel (RGBY mode) or the like. When including more than three sub-pixels of different colors, each sub-pixel or virtual pixel is still square, but the number of the corresponding virtual sub-pixels may be changed (for example, there may be four corresponding virtual sub-pixels). Meanwhile, the display method may be changed accordingly, for example, when the white sub-pixels are included, the white sub-pixels are used to compensate for brightness, therefore, the white sub-pixels may not be subjected to the above "sampling" process, and may only be lighted up according to the overall brightness; and when the yellow sub-pixels are included, the yellow sub-pixels may be sampled by using the same manner as above, and their specific pixel form, selection of the sampling virtual sub-pixels, assignment of the weight coefficients and the like may be changed, and will not be described in detail herein as these aspects may be decided by persons skilled in the art as desired.

Embodiment 2

The present embodiment provides a display device comprising a display panel, wherein the display panel comprises pixels arranged in a matrix, which comprises multiple rows of sub-pixels, each row of sub-pixels are formed of sub-pixels of various colors which are alternately and circularly arranged, the sub-pixels in each row are arranged in the same order, and in column direction, and sub-pixels of the same color are not adjacent, wherein the display device further comprises:

a primary image generating module for generating a primary image based on image information, the primary image is formed of virtual pixels arranged in a matrix, each of the virtual pixels is formed of sub-pixels of different colors and size of the virtual sub-pixel is the same as that of the sub-pixel of the display panel;

a display component calculating module for calculating a display component of each sub-pixel by using a primary component of sampling virtual sub-pixels of the sub-pixel, wherein sampling virtual sub-pixels of one sub-pixel include multiple virtual sub-pixels, which are adjacent to a corresponding position of the one sub-pixel in the primary image and have the same color as the one sub-pixel; and a display driving module for driving the sub-pixels of the display panel to display according to their respective display components.

In the display device in the present embodiment using the display method provided by the embodiment of the invention, the visual resolution is relatively high, and the display effect is improved, meanwhile, amount of calculation is reduced.

The display device of the embodiment may be any product or part which is provided with a display function such as a liquid crystal panel, an electronic paper, an organic light emitting diode (OLED) panel, a liquid crystal TV, a liquid crystal display, a digital image frame, a mobile phone, and a tablet computer.

It should be understood that, the above embodiments are only exemplary embodiments used to explain the principle of the present invention and the protection scope of the present invention is not limited thereto. The person skilled in the art can make various variations and modifications without departing from the spirit and scope of the present invention, and these variations and modifications should be considered to belong to the protection scope of the invention.

The invention claimed is:

1. A display method, which is applicable to a display panel comprising multiple rows of sub-pixels, each row of sub-pixels are formed of sub-pixels of various colors which are alternately and circularly arranged, the sub-pixels in each row are arranged in the same order, and in column direction, sub-pixels of the same color are not adjacent, wherein the display method comprises steps of:

S1, generating a primary image based on image information, wherein the primary image is formed of virtual pixels arranged in a matrix, each of the virtual pixels is formed of sub-pixels of different colors and size of the virtual pixel is the same as that of the sub-pixel of the display panel;

S2, calculating a display component of each sub-pixel by using primary components of sampling virtual sub-pixels of the sub-pixel, wherein sampling virtual sub-pixels of one sub-pixel include multiple virtual sub-pixels, which are adjacent to a corresponding position of the one sub-pixel in the primary image and have the same color as the one sub-pixel.

2. The display method of claim 1, wherein both of the sub-pixel and the virtual pixel are square.

3. The display method of claim 2, wherein the step S2 comprises:

multiplying primary components of respective sampling virtual sub-pixels of one sub-pixel by weight coefficients of the respective sampling virtual sub-pixels, and adding them up to obtain a display component of the sub-pixel.

4. The display method of claim 1, wherein the display panel consists of a plurality of pixels, and each of the pixels comprises multiple sub-pixels, which are adjacent and have different colors, and wherein the sampling virtual sub-pixels of one sub-pixel comprise a virtual pixel, which has the same color as the one sub-pixel and corresponds to a corresponding position of a pixel including the one sub-pixel in the primary image.

5. The display method of claim 4, wherein the sampling virtual sub-pixels of one sub-pixel further comprise at least one virtual sub-pixel, which has the same color as the one sub-pixel and is adjacent to a corresponding position of a pixel including the one sub-pixel in the primary image.

6. The display method of claim 5, wherein the step S2 comprises:

multiplying primary components of respective sampling virtual sub-pixels of one sub-pixel by weight coefficients of the respective sampling virtual sub-pixels, and adding them up to obtain a display component of the sub-pixel.

7. The display method of claim 4, wherein each row of sub-pixels in the display panel are formed of sub-pixels of three colors which are alternately and circularly arranged; and each virtual pixel of the primary image consists of three virtual sub-pixels of different colors.

8. The display method of claim 7, wherein any two adjacent sub-pixels in column direction are staggered by 1/2 sub-pixels in row direction; and each pixel includes two adjacent sub-pixels in the same row, and a sub-pixel which is in an adjacent row and is in the middle of the two adjacent sub-pixels in row direction.

9. The display method of claim 7, wherein any two adjacent sub-pixels in column direction are aligned in row direction, and each pixel includes two adjacent sub-pixels in the same column, and a sub-pixel which is in an adjacent column and is in the same row as one of the two adjacent sub-pixels.

10. The display method of claim 7, wherein any two adjacent sub-pixels in column direction are aligned in row direction, and each pixel includes three continuous sub-pixels in the same row.

11. The display method of claim 7, wherein the step S2 comprises:

multiplying primary components of respective sampling virtual sub-pixels of one sub-pixel by weight coefficients of the respective sampling virtual sub-pixels, and adding them up to obtain a display component of the sub-pixel.

12. The display method of claim 4, wherein the step S2 comprises:

multiplying primary components of respective sampling virtual sub-pixels of one sub-pixel by weight coefficients of the respective sampling virtual sub-pixels, and adding them up to obtain a display component of the sub-pixel.

13. The display method of claim 1, wherein the step S2 comprises:

multiplying primary components of respective sampling virtual sub-pixels of one sub-pixel by weight coefficients of the respective sampling virtual sub-pixels, and adding them up to obtain a display component of the sub-pixel.

14. The display method of claim 13, wherein a sum of the weight coefficients of the sampling virtual sub-pixels of one sub-pixel is 1.

15. The display method of claim 14, wherein the sampling virtual sub-pixels of one sub-pixel include a main sampling virtual sub-pixel, which is a virtual sub-pixel and has the same color as the sub-pixel, and which corresponds to a corresponding position of the sub-pixel in the primary image; and among the sampling virtual sub-pixels of one sub-pixel, the main sampling virtual sub-pixel has the largest weight coefficient.

16. The display method of claim 15, wherein the main sampling virtual sub-pixel has a weight coefficient ranging from 0.5 to 0.9.

17. The display method of claim 16, wherein the sampling virtual sub-pixels of one sub-pixel, except the main sampling virtual sub-pixel, have weight coefficients ranging from −0.1 to 0.3.

18. A display device comprising a display panel, wherein the display panel comprises pixels arranged in a matrix, which include multiple rows of sub-pixels, each row of sub-pixels are formed of sub-pixels of various colors which are alternately and circularly arranged, the sub-pixels in each row are arranged in the same order, and in column direction, sub-pixels of the same color are not adjacent, wherein the display device further comprising:

a primary image generating module for generating a primary image based on image information, the primary image is formed of virtual pixels arranged in a matrix, each of the virtual pixels is formed of sub-pixels of different colors and size of the virtual sub-pixel is the same as that of the sub-pixel of the display panel;

a display component calculating module for calculating a display component of each sub-pixel by using primary components of sampling virtual sub-pixels of the sub-pixel, wherein sampling virtual sub-pixels of one sub-pixel include multiple virtual sub-pixels, which are adjacent to a corresponding position of the one sub-pixel in the primary image and have the same color as the one sub-pixel; and a display driving module for driving the sub-pixels of the display panel to display according to their respective display components.

* * * * *